US007331758B2

(12) United States Patent
Arinaga et al.

(10) Patent No.: US 7,331,758 B2
(45) Date of Patent: Feb. 19, 2008

(54) BLOWER

(75) Inventors: Masahiro Arinaga, Tokyo (JP); Kunihiko Kaga, Tokyo (JP); Shoji Yamada, Tokyo (JP); Katsuhisa Ootsuta, Tokyo (JP); Hitoshi Kikuchi, Tokyo (JP); Yoshimi Iwamura, Tokyo (JP); Yasuyoshi Makino, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 334 days.

(21) Appl. No.: 10/521,787

(22) PCT Filed: Jun. 17, 2004

(86) PCT No.: PCT/JP2004/008839

§ 371 (c)(1),
(2), (4) Date: Jan. 21, 2005

(87) PCT Pub. No.: WO2004/113732

PCT Pub. Date: Dec. 29, 2004

(65) Prior Publication Data

US 2005/0260075 A1 Nov. 24, 2005

(30) Foreign Application Priority Data

Jun. 18, 2003 (JP) ..... 2003-173867

(51) Int. Cl.
*F04D 29/54* (2006.01)

(52) U.S. Cl. ..... 415/221; 416/228

(58) Field of Classification Search ..... 415/220, 415/221; 416/228

See application file for complete search history.

(56) References Cited

U.S. PATENT DOCUMENTS

| | | | | |
|---|---|---|---|---|
| 4,927,328 | A * | 5/1990 | Scoates et al. | 415/220 |
| 5,273,400 | A | 12/1993 | Amr | |
| 5,551,841 | A * | 9/1996 | Kamada | 417/89 |

FOREIGN PATENT DOCUMENTS

| | | | |
|---|---|---|---|
| JP | 53-116513 | | 10/1978 |
| JP | 63-36697 | U | 3/1988 |
| JP | 2-207197 | | 8/1990 |
| JP | 9-68199 | | 3/1997 |
| JP | 2002022210 | A * | 1/2002 |

* cited by examiner

*Primary Examiner*—Ninh H. Nguyen
(74) *Attorney, Agent, or Firm*—Leydig, Voit & Mayer, Ltd.

(57) ABSTRACT

A blower includes: an impeller on which there are arranged axial flow blades 40 mounted at circumferential intervals to an outer peripheral surface of a boss; a case surrounding the impeller; and a bell mouth cylindrically constricted to guide gas into the case, wherein an inner diameter of the bell mouth is smaller than an outer diameter of the impeller. Further, each blade has, in the radial direction, a sweepforward wing portion situated on the boss side and exhibiting a positive advance ratio value, and a sweepback wing portion situated on the outer peripheral side of the blade and exhibiting a negative advance ratio value, with the arc length of each blade increasing from the boss side toward the outer peripheral side. Therefore, it is possible to achieve an improvement in ventilation efficiently, through an increase in static pressure and to achieve a reduction in noise.

13 Claims, 8 Drawing Sheets

BLOWER

TECHNICAL FIELD

This invention relates to a blower used, for example, for ventilation.

BACKGROUND ART

To achieve an improvement in efficiency in a blower, it is necessary to increase the static pressure, so that it is important that the flow in the centrifugal direction be increased in the relative flow field and that the velocity in the flow direction be reduced.

Generally speaking, in a conventional blower, to increase the flow in the centrifugal direction, it is necessary to turn the flow behind the blades into a mixed flow. In view of this, for example, JP 53-116513 A discloses a construction in which the portion of the reference line of each blade from the root to the middle portion thereof is bent at a predetermined angle of inclination in the rotating direction, and the portion of the reference line from the middle portion to the tip end portion of the blade is bent at a predetermined angle of inclination in a direction opposite to the rotating direction so that the outermost end of the reference line may be situated on the side opposite to the rotating direction with respect to the line connecting the rotation center and the above-mentioned root.

The above conventional blower is basically a so-called axial blower, in which air flows substantially along the axial direction. Thus, in its outer peripheral portion, the effect of mixed flow due to the blade profile is rather small, with the result that a sufficient increase in static pressure cannot be achieved, leading to poor ventilation efficiency, an increase in noise, etc.

DISCLOSURE OF THE INVENTION

This invention has been made with a view toward solving the above problems. It is an object of this invention to provide a blower in which an improvement in ventilation efficiency is achieved through an increase in static pressure, etc. and in which it is possible to achieve a reduction in noise.

This invention provides a blower including: an impeller on which a plurality of axial flow blades are arranged while mounted at circumferential intervals to an outer peripheral surface of a boss; a case surrounding the impeller; and a bell mouth cylindrically constricted so as to guide a gas into the case, in which an inner diameter of the bell mouth is smaller than an outer diameter of the impeller.

Further, this invention provides a blower including: an impeller on which a plurality of blades are arranged while mounted at circumferential intervals to an outer peripheral surface of a boss; a case surrounding the impeller; and a bell mouth cylindrically constricted so as to guide a gas into the case, in which an inner diameter of the bell mouth is smaller than an outer diameter of the impeller, and in which a portion of the blade portion situated on an outer peripheral side of the inner diameter of the bell mouth protrudes from a reduction diameter side end portion toward an expansion diameter side end portion of the bell mouth in a direction along a rotation center axis of the impeller.

Further, this invention provides a blower including a boss and a plurality of blades mounted at circumferential intervals to an outer peripheral surface of the boss, characterized in that, when the blades of the impeller are projected onto a plane perpendicular to the rotation center axis thereof, each of curves that are formed by connecting center points of arc lengths of circumferentially extending arcs formed through overlapping of concentric circles, which radially extend around an intersection point of the plane and the rotation center axis, and the projected blades, is defined as a circumferential center curve, when an angle made by a straight line connecting the intersection point and a boss-side end point of the circumferential center curve and by a straight line connecting the intersection point and an arbitrary point in the circumferential center curve is defined as a forward angle $\theta$ with a rotating direction of the blades taken as positive, and when a change ratio per unit radial length of the forward angle $\theta$ is defined as an advance ratio, each blade has, in a radial direction, a sweepforward wing portion which is on a boss side and which exhibits a positive value of the advance ratio, and a sweepback wing portion which is on an outer peripheral side of the blade and which exhibits a negative value of the advance ratio, with the arc length of each blade increasing from the boss side toward the outer peripheral side.

BEST MODE FOR CARRYING OUT THE INVENTION

Figure 1:
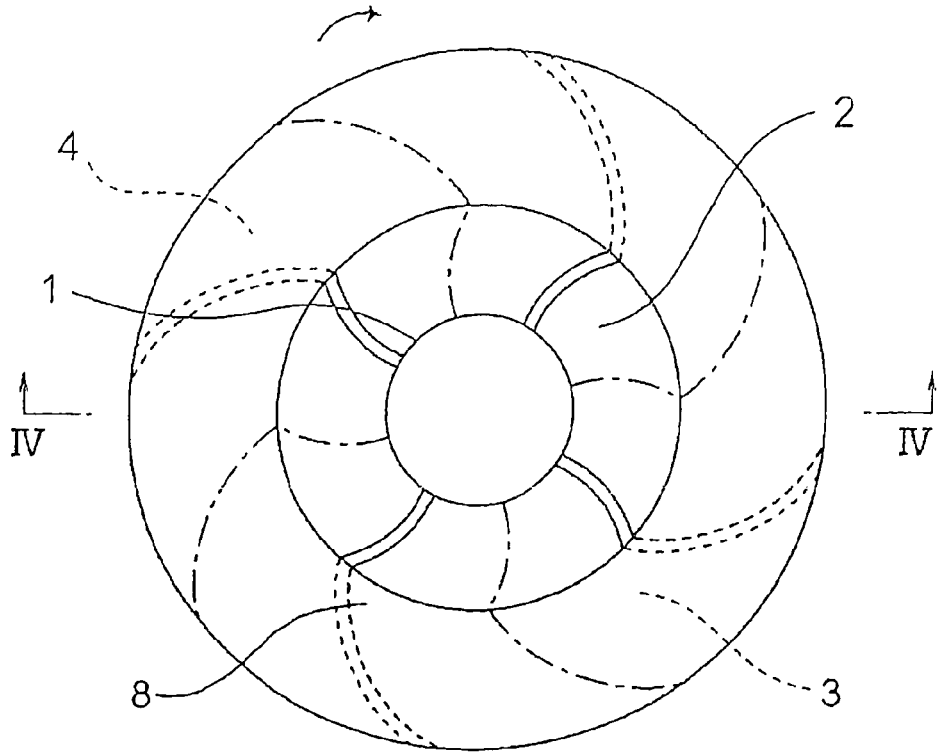
FIG. 1 is a front view of a blower according to Embodiment 1 of this invention.

In the following, preferred embodiments of this invention will be described with reference to the drawings; in the following description, the components and portions of the embodiments that are the same or equivalent are indicated by the same reference numerals.

Embodiment 1

Figure 2:
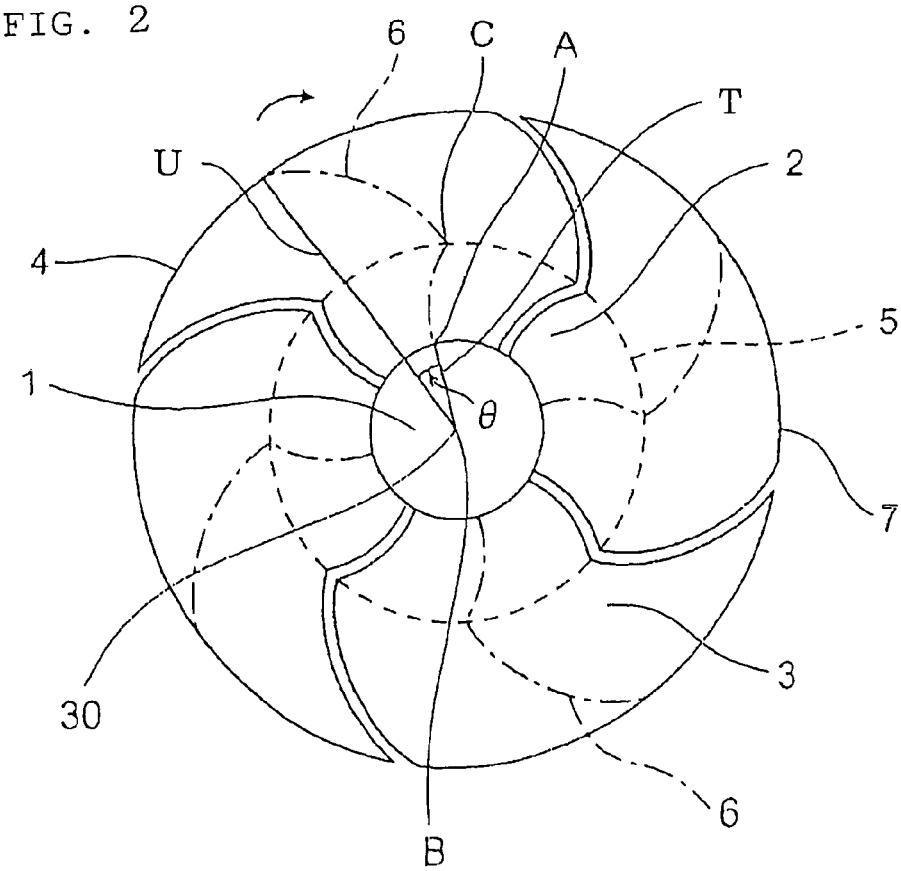
FIG. 2 is a front view of the blower of FIG. 1 with a bell mouth removed therefrom.
Figure 3:
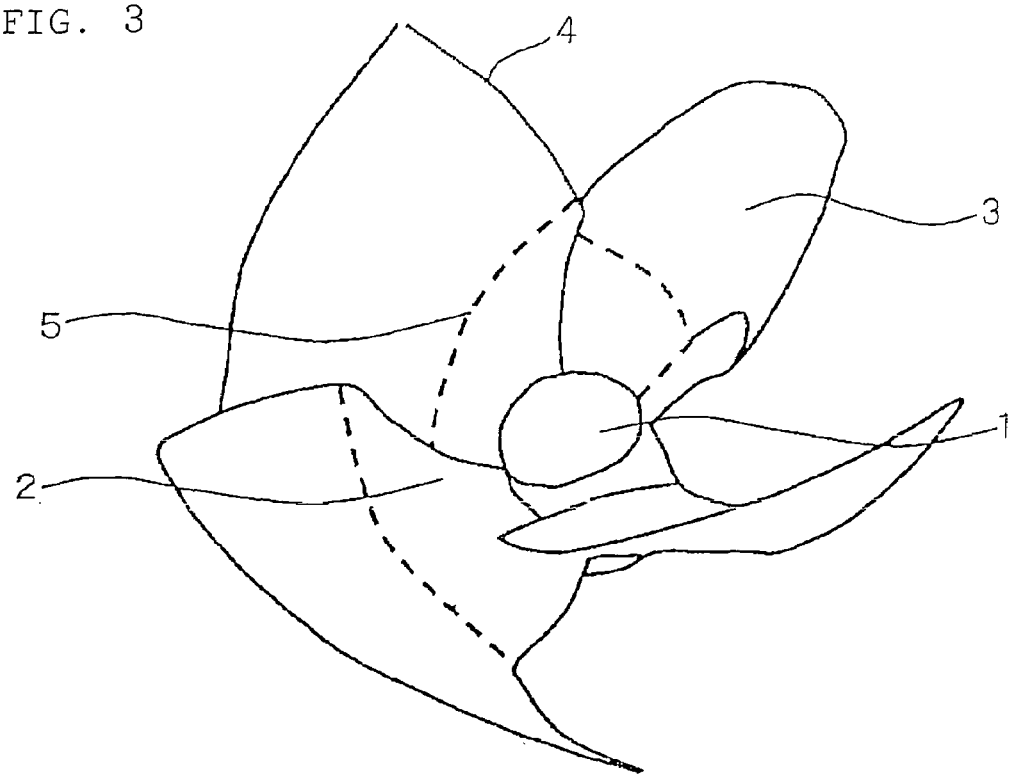
FIG. 3 is a perspective view of the blades of the blower of FIG. 1.
Figure 4:
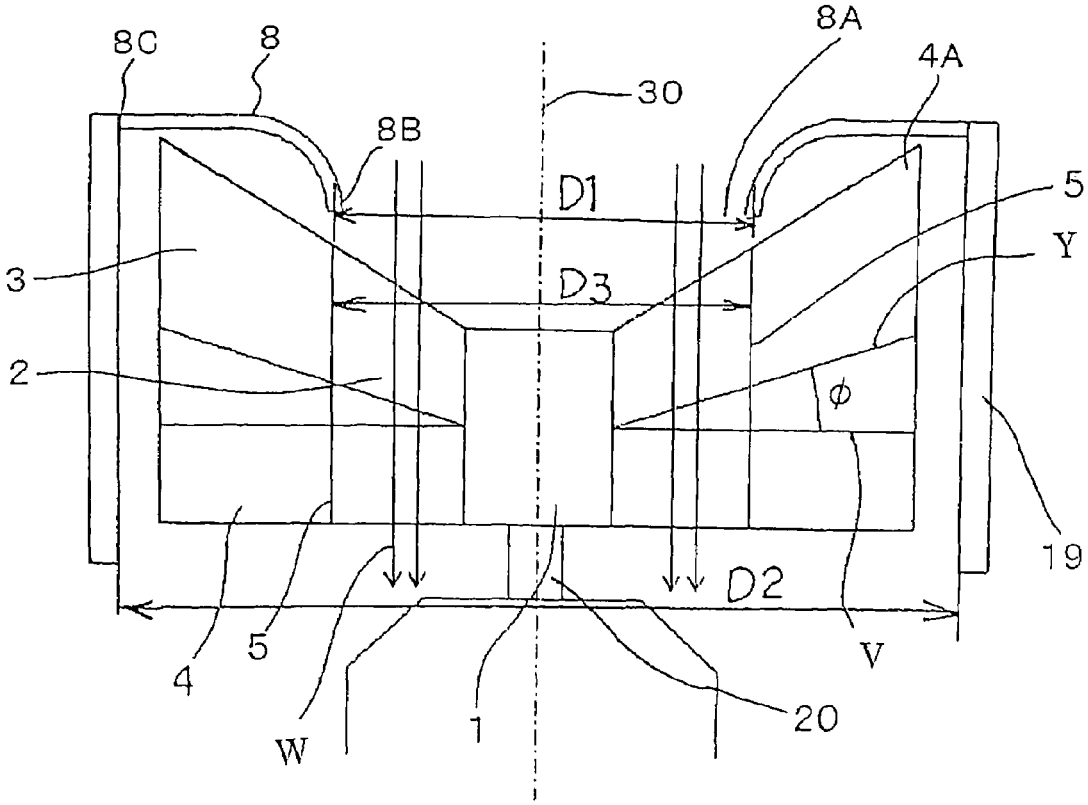
FIG. 4 is a sectional view of the blower of FIG. 1, taken along the line IV-IV, when the blades are rotating, showing the air flow when a large air capacity is to be achieved.
Figure 5:
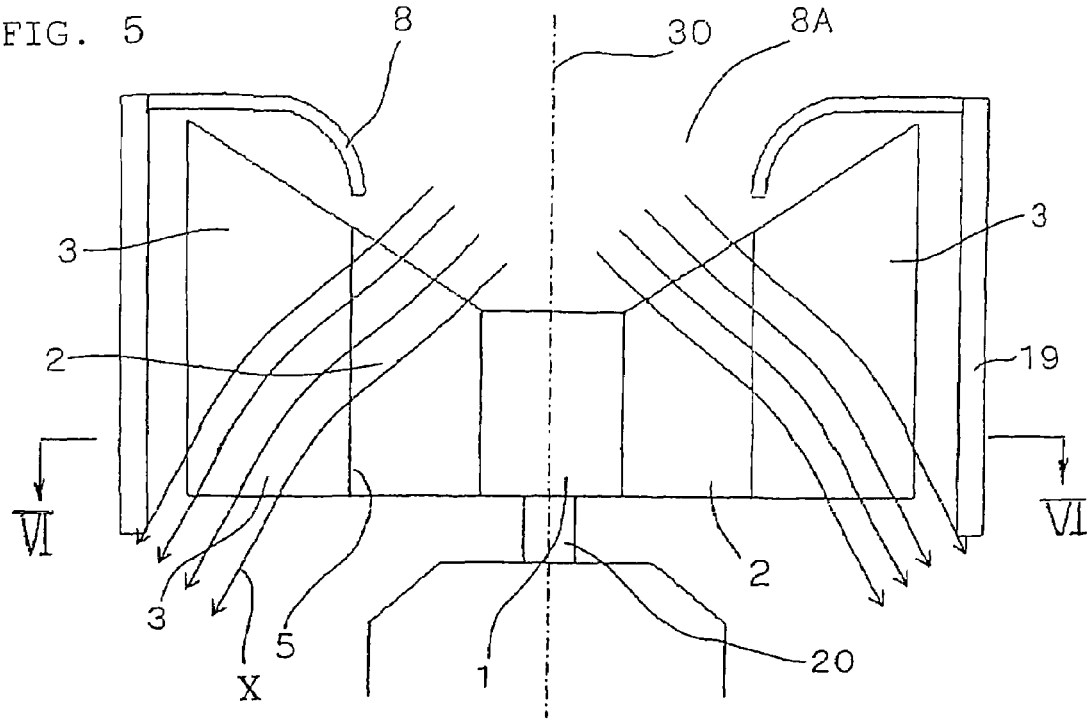
FIG. 5 is a sectional view of the blower of FIG. 1, taken along the line IV-IV, when the blades are rotating, showing the air flow when a small air capacity is to be achieved.
Figure 6:
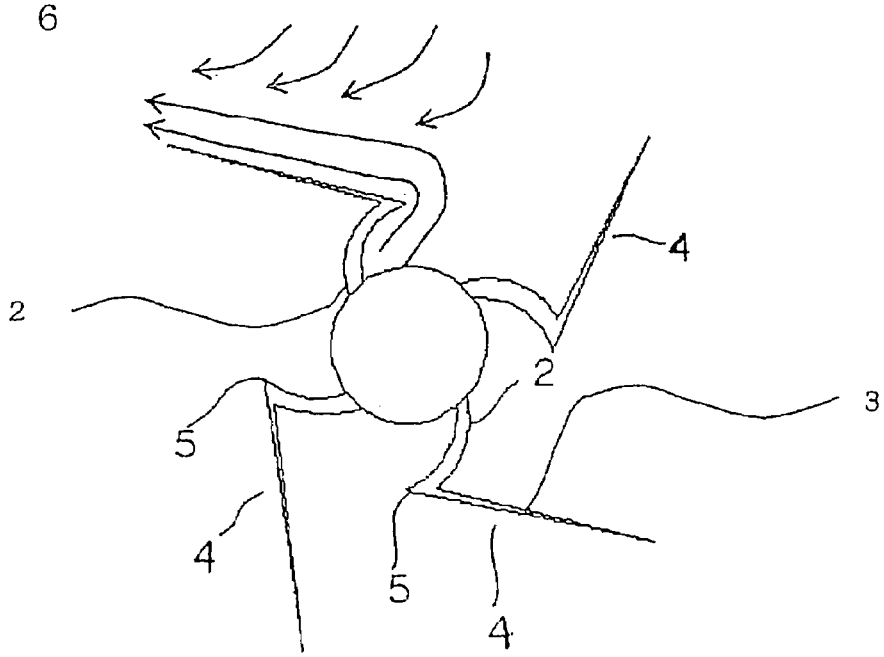
FIG. 6 is a sectional view taken along the line VI-VI of FIG. 5.

FIG. 1 is a front view of a blower according to Embodiment 1 of this invention as seen from the suction side thereof, FIG. 2 is a front view of the blower of FIG. 1 with a bell mouth 8 removed therefrom, FIG. 3 is a perspective view of blades 4 of the blower of FIG. 1, FIGS. 4 and 5 are sectional views taken along the line IV-IV of FIG. 1 when the blades 4 are rotating, and FIG. 6 is a sectional view taken along the line VI-VI of FIG. 5. FIG. 2 shows how the blades 4 are projected onto a plane perpendicular to a rotation axis 30 which is the center axis of a boss 1; it is a front view, as seen from the suction side, of a plane perpendicular to the rotation axis 30.

This blower is equipped with a motor shaft 20, a cylindrical boss 1 directly connected to the motor shaft 20 so as to be concentric therewith, four blades 4 mounted to the outer peripheral surface of the boss 1 circumferentially at equal intervals, a cylindrical case 19 surrounding the blades 4, and the bell mouth 8 mounted to the suction side end of the case 19 and adapted to guide air into the interior of the case 19.

The boss 1 and the four blades 4 constitute an impeller; the arrow in FIGS. 1 and 2 indicate the rotating direction of the impeller (boss 1). The rotation axis 30, which is the center axis of the boss 1, coincides with the rotation center axis of the impeller.

In this specification, a device arranged on the flow suction side and having a curved portion smoothly guiding air flow to the impeller is called a bell mouth.

Each blade 4 is composed of a sweepforward wing portion 2 and a sweepback wing portion 3.

Here, the sweepforward wing portion 2 and the sweepback wing portion 3 will be described.

First, as shown in FIG. 2, when the blades 4 are projected onto a plane perpendicular to the rotation axis 30, which is the center axis of the boss 1, each of curves that are formed by connecting center points of arc lengths of circumferentially extending arcs formed through overlapping of concentric circles, which radially extend around a second center point B that is the intersection of the plane and the rotation center axis 30, and the projected blades 4, is defined as a circumferential center curve 6. An angle made by a straight line T connecting the second center point B and a first center point A that is a boss-side end point of the circumferential center curve 6 and by a straight line U connecting the second center point B and an arbitrary point in the circumferential center curve 6 is defined as a forward angle θ (the outermost peripheral end of each blade 4 in FIG. 2) with a rotating direction of the blades taken as positive. Further, a change ratio per unit radial length of the forward angle θ is defined as an advance ratio (°/mm).

It is to be assumed that, when the plane perpendicular to the rotation axis 30 is seen from the suction side, the forward angle θ in the clockwise rotating direction of each blade 4 rotating from the first straight line T is positive, and that it is negative in the rotating direction opposite thereto.

In FIGS. 1 and 2, the blades 4 are rotated in the right-hand direction as seen from the direction of the plane perpendicular to the rotation shaft 30, and the sucking direction is from the front side toward the back side of the plane of the drawing. The forward angle θ of each blade 4 is a positive value when the second straight line U is on the right-hand side with respect to the first straight line T, and is a negative value when the second straight line U is on the left-hand side with respect to the first straight line T. And, the portion of each blade 4 exhibiting a positive advance ratio value in the radial direction is the sweepforward wing portion 2, and the portion thereof exhibiting a negative advance ratio value is the sweepback wing portion 3.

Each blade 4, composed of the sweepforward wing portion 2 and the sweepback wing portion 3, increases in arc length dimension from the boss 1 side toward the outer peripheral side portion 7. Further, the arcuate shape of the boundary portion 5 between the sweepforward wing portion 2 and the sweepback wing portion 3 substantially coincides with the arcuate shape at a radial position of the blade 4. The advance ratio, which is a change per unit radial length in the forward angle θ of this blade 4, is zero at the position of the intersection point C of the boundary portion 5 and the circumferential center curve 6; the blade portion on the outer diameter (outer peripheral) side of this point C is the sweepback wing portion 3, where the advance ratio θ is negative, and the portion thereof on the inner diameter (boss) side of this intersection point C is the sweepforward wing portion 2, where the advance ratio is positive.

In this specification, the blade 4, constructed as described above, is referred to as a composite blade, and a blade as used in an ordinary axial blower is referred to as an axial flow blade. As described in detail below, in the composite blade, the sweepforward wing portion 2 functions mainly as an axial blower, and the sweepback wing portion 3 functions mainly as a centrifugal blower.

As shown in FIG. 4, the diameter D1 of the opening 8A of the bell mouth 8 mounted to the air suction side of the blades 4 substantially coincides with the diameter D3 of the boundary portion 5. Here, it is to be assumed that this substantial coincidence in diameter holds true within a range in which the dimensional ratio between the diameter D1 of the bell mouth 8 and the diameter D3 of the boundary portions 5 of the blades 4 show a deviation of approximately 10% or less.

Figure 15:
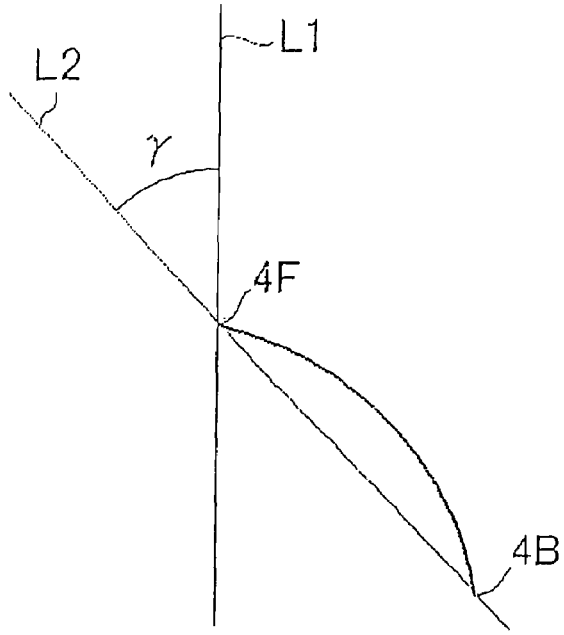
FIG. 15 is a diagram for illustrating a stagger angle in Embodiment 1.

Further, as shown in FIG. 15, the blades 4 of this embodiment are formed as follows: in a cascade of blades in which the blades 4 are developed in cylindrical planes of different diameters, assuming that the angle (stagger angle), as seen from the suction side, formed by a straight line L2 connecting a front end portion 4F on the front side of each blade with respect to the rotating direction thereof and a rear end portion 4B on the rear side of the blade with respect to the rotating direction thereof and by a straight line L1 parallel to the rotation center axis direction is γ, the angle γ is in the range from 0° to 90° as measured in the counterclockwise direction as seen in the plane of FIG. 15.

Figure 16:
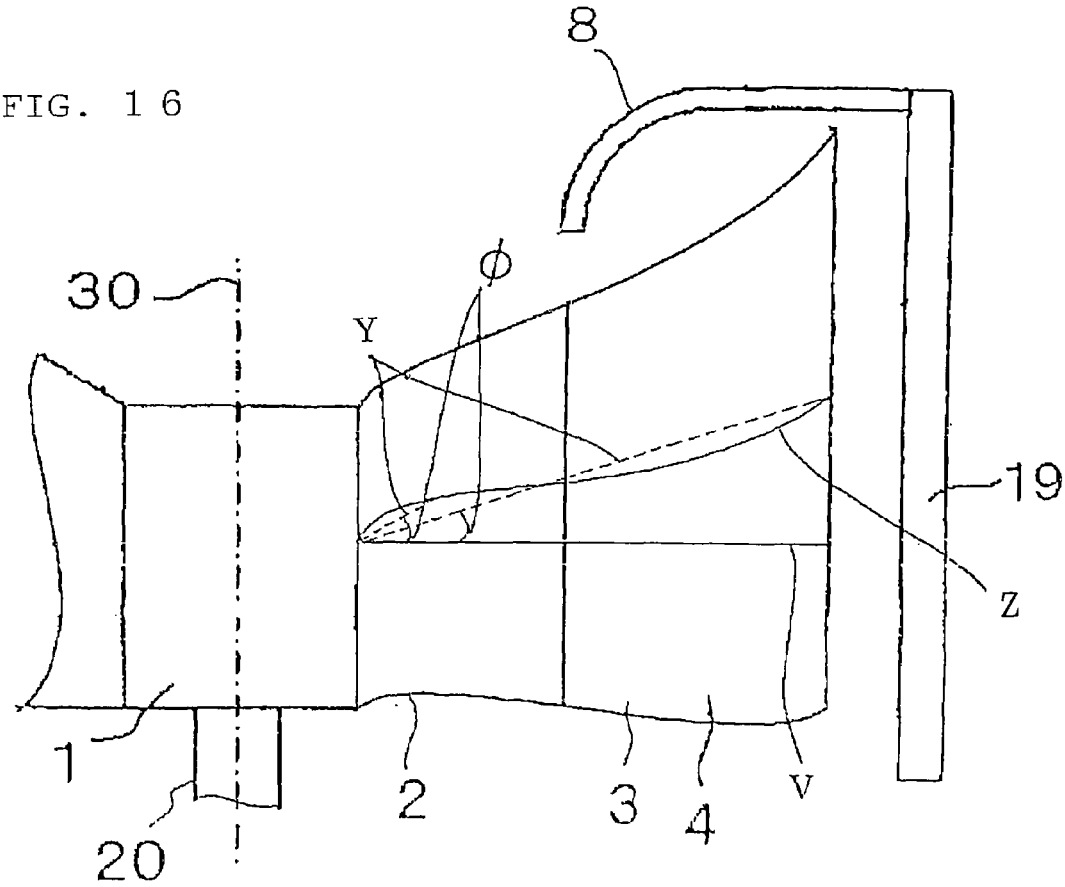
FIG. 16 is a diagram for illustrating a radial direction center axis in Embodiment 1.

Further, as shown in FIG. 16, a straight line extended from the center point of the height in the direction of the rotation center axis (rotation axis) 30 at the portion of the blade 4 in contact with the boss 1 to the outer peripheral portion of the blade perpendicularly to the axis is defined as a straight line V. Further, a line connecting the center points in the axial height at each radius of the blade portion is defined as a radial direction center line Z. A straight line connecting the center point of the boss portion with respect to the axial height and an arbitrary point in the radial direction center line Z is defined as a straight line Y. The angle made by the straight line Y and the straight line V is defined as an angle $\phi$. Assuming that the gas suction side (the upper side in the plane of the drawing) of the straight line V is positive, and that the gas discharge side (the lower side in the plane of the drawing) of the straight line V is negative, $\phi>0$. In other words, the four blades 4 arranged on the outer peripheral surface of the boss 1 are inclined toward the suction side at the angle $\phi>0$ with respect to a plane perpendicular to the rotation axis 30. That is, the straight line Y is inclined toward the gas suction side with respect to the straight line V.

As a result, the curved surface of the impeller on the pressure surface side is inclined toward the discharge side and toward the outer peripheral side, making it possible to generate a flow directed radially outwards and to achieve an increase in static pressure.

While in the example shown in FIG. 16 the radial direction center line Z is a curve, it may also be a straight line. In the case shown in FIG. 4, the radial direction center line Z is a straight line, and the straight line Y overlaps the radial direction center line Z.

Further, in the sweepforward wing portion 2, which is in the region on the inner peripheral side of the diameter D1 of the bell mouth 8, this blade 4 exhibits a circumferential sectional configuration (sectional configuration obtained by cutting the blade 4 perpendicularly to the rotation axis 30) that is similar to that of a blade of an axial blower (axial flow blade), and generates a flow along the rotation center axis 30 as indicated by the arrow of FIG. 4. Further, in the sweepback wing portion 3, which is on the outer diameter side of the diameter D1 of the bell mouth 8, the blade resembles a blade of a centrifugal blower (referred to as a centrifugal blade in this specification), and generates a meridional flow radially spreading as indicated by the arrow in FIG. 6, and a flow field similar to that of a centrifugal blower is realized.

Due to this construction, it is possible to realize a blower providing both the high static pressure characteristic of a centrifugal blower and the large air capacity characteristic of an axial blower.

When a large air capacity is to be achieved, the blower constructed as described above is in the state as shown in FIG. 4. That is, as indicated by the arrow W, the meridional flow is such that the fluid flows substantially along the direction of the center axis 30, and, since the circumferential sectional configuration of the blades 4 is the same as that of an axial blower, the blower operates as an axial blower.

In contrast, when a small air capacity is to be obtained, the blower is in the state as shown in FIG. 5. That is, the diameter of the opening 8A of the bell mouth 8 (D1 in FIG. 4) is smaller than the inner diameter (D2 in FIG. 4) of the case 19, and the meridional flow increases in mixed flow component as indicated by the arrow X, and the fluid flows out as a mixed flow from the sweepback wing portion 3, whose advance ratio is negative; since this sweepback wing portion 3 has a blade profile substantially coinciding with the meridional flow spreading in the centrifugal direction, the load on the blades 4 is reduced, and the ventilation efficiency is enhanced.

In this way, each blade 4 has, in the radial direction, the sweepforward wing portion 2 situated on the boss 1 side and exhibiting a positive advance ratio value, and the sweepback wing portion 3 situated on the outer peripheral side of the blade 4 and exhibiting a negative advance ratio value. Further, the arc length of each blade 4 increases from the boss 1 side toward the outer peripheral side. Thus, the arc length of the blade increases in the radial direction toward the outer peripheral side, so that the blade area along the flow increases in the blade outer peripheral portion, and there is a substantial increase in blade radius with respect to the flow, with the result that there is an increase in static pressure due to centrifugal force, making it possible to increase the work-load of the blade.

Further, in each circumferential center curve 6 of the sweepforward wing portion 2, the angle of inclination of a tangent to the circumferential center curve 6 gradually increases to a large degree in the rotating direction as transition is effected from the boss 1 side toward the boundary portion 5 side, with the rotation axis serving as a reference; further, as transition is effected from the boundary portion 5 side toward the outer peripheral side, the angle of inclination of the tangent to the circumferential center curve 6 increases gradually to a large degree to the opposite side with respect to the rotating direction.

As a result, in the sweepforward wing portion 2, the same flow as in an axial blower is obtained, which means the blower operates as an axial blower. On the outer peripheral side of this blade 4, the advance ratio is reduced to a negative value so as to attain substantial coincidence with the flow, and the portion corresponding to the sweepback wing portion 3 resembles a blade of a centrifugal blower, which means the blower operates as a centrifugal blower.

Thus, in the blower of this embodiment, it is possible to provide the functions of both an axial blower and a centrifugal blower; further, it is possible to adapt the blade profile to two flow fields: the flow field spreading in the radial direction similar to that in a centrifugal blower generated due to the installation of the bell mouth and to the flow field similar to that in an axial blower flowing parallel to the rotation center axis, thereby making it possible to suppress an increase in noise due to disturbance.

Further, in each circumferential center curve 6 of the sweepforward wing portion 2, the angle of inclination of a tangent to the circumferential center curve 6 gradually increases to a large degree in the gas discharge side as the circumferential center curve 6 extends from the boss 1 side toward the boundary portion 5 side, with the rotation axis serving as a reference; further, the circumferential center curve 6 extends from the boundary portion 5 side toward the outer peripheral side, the angle of inclination of the tangent to the circumferential center curve 6 increases gradually to a large degree to the gas suction side. Accordingly, the curved surface of the impeller is inclined toward the outer peripheral side, making it possible to generate a flow directed radially outwards and to achieve an increase in static pressure.

Further, by mounting the bell mouth 8 to the air suction side of the case 19, the nozzle size of the blower on the suction side is equal to the diameter D1 of the bell mouth 8, and the suction area is reduced. In the sweepforward wing portion 2, which is in the region where the flow field is in the same condition as in an axial blower and where the diameter of the blade 4 is smaller than the diameter D1 of the bell mouth 8, the suction side diameter of the impeller is equal to the diameter D1 of the bell mouth 8, and the flow is the same as that in an axial blower for both large and small air capacity, so that the blower operates as an axial blower.

In contrast, in the sweepback wing portion 3, which is in the region where the flow field constitutes a flow directed outwards in the radial direction and where the nozzle size of the blade 4 is larger than the diameter D1 of the bell mouth 8, the advance ratio is, as described with reference to FIG. 6, reduced to a negative value, with respect to a flow causing centrifugal expansion of the section of the sweepback wing portion 3 of the blade 4, so as to attain substantial coincidence with the flow on the outer peripheral side of this blade 4, and the portion corresponding to the sweepback wing portion 3 resembles a blade of a centrifugal blower, so that the blower operates as a centrifugal blower.

Thus, this blower is endowed with the functions of both an axial blower and a centrifugal blower, and an increase in total pressure (Euler head) due to centrifugal force is to be expected, thus making it possible to achieve an increase in static pressure.

Figure 7:
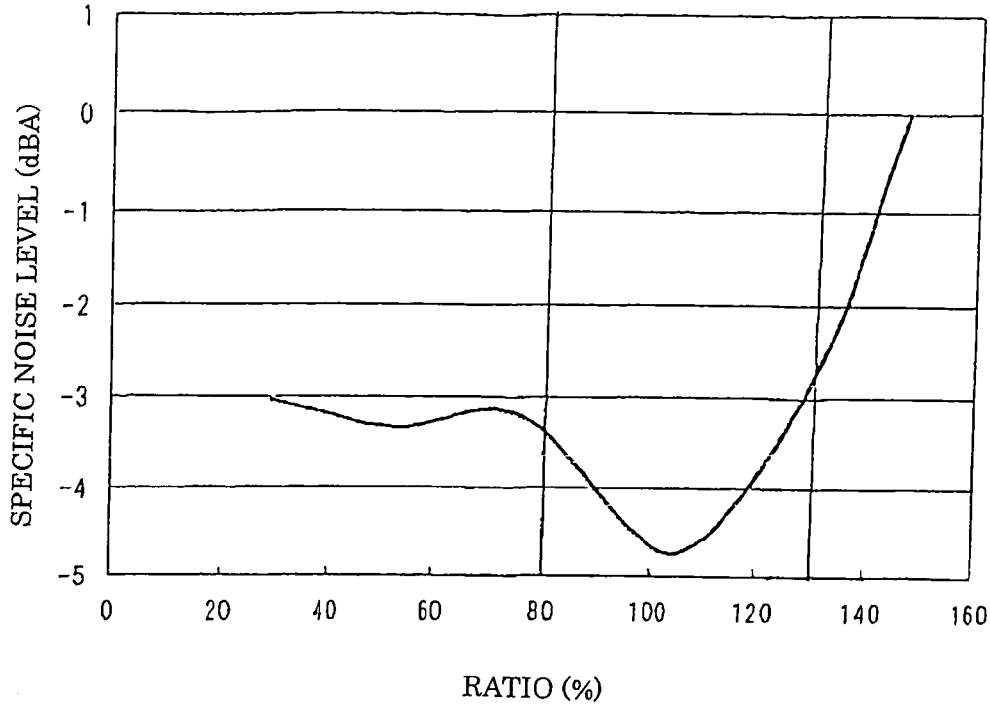
FIG. 7 is a diagram showing the relationship between ratio (%) and specific noise level (dBA) in the blower of Embodiment 1.
Figure 9:
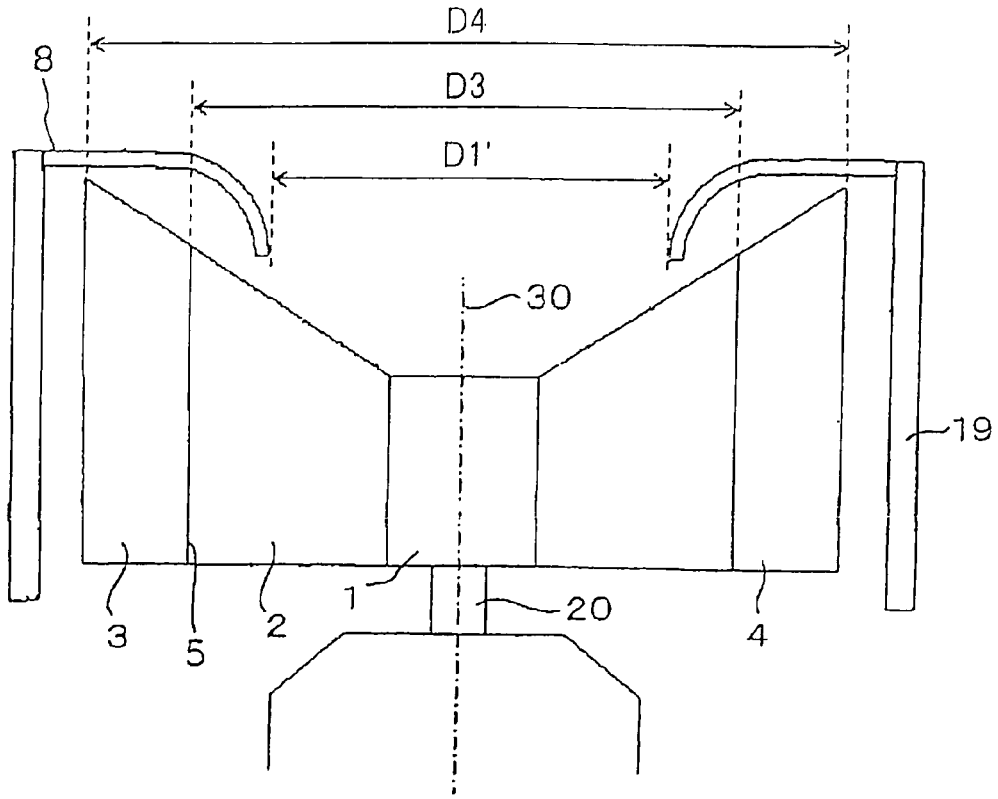
FIG. 9 is a sectional view, taken along the rotation center axis, of a blower according to Embodiment 2 of this invention when the blades thereof are rotating.

FIG. 7 is a diagram showing the performance of the above-described blower as tested by experiment by the inventor of this invention; the abscissa indicates the ratio of the diameter D3 of the boundary portion 5 to the inner diameter D1' of the bell mouth 8, D3/D1' (%), when the diameter D3 of the boundary portion 5 is varied, with the inner diameter D1' of the bell mouth 8 being fixed; and the ordinate indicates the specific noise level value (dBA), which is smaller when the bell mouth 8 is mounted to the case 19 under a condition of a substantially maximum efficiency point as compared with the case in which no bell mouth 8 is mounted. Here, it is to be noted that, as shown in FIG. 9, the inner diameter D1' of the bell mouth 8 is the diameter of the inner surface of the reduction diameter portion of the bell mouth 8. Further, the diameter D1 of the bell mouth 8 shown in FIG. 4 is the diameter of the thickness center portion of the reduction diameter portion of the bell mouth 8, and the inner diameter D11 of the bell mouth 8 and the diameter D1 are substantially equal to each other. Further, here, the term maximum efficiency point refers to the point providing the maximum ventilation efficiency ((static pressure)×(air capacity)/(motor output)) when the outer diameter of the blade 4 (that is, the outer diameter of the impeller formed by the boss 1 and the four blades 4) is varied, with the diameter D1 of the opening 8A of the bell mouth 8 (the inner diameter D1') being fixed.

It can be seen from this diagram that when the profile of the blade 4 is such that the ratio ranges from 80% to 130%, it is possible to achieve a marked reduction in blower noise from approximately 3.0 (dBA) to approximately 4.7 (dBA); with a ratio of 105%, the specific noise level is reduced by 4.7 (dBA) at maximum. When the ratio ranges from 100% to 110%, the specific noise level is reduced by 4.5 (dBA) or more, thus providing an especially marked noise reduction effect. Further, as can be seen from this diagram, at the ratio of 147%, the specific noise level is zero; in this condition, the bell mouth 8 does not contribute to a reduction in specific noise level, and the effect obtained is the same as that obtained when there is no bell mouth 8.

Figure 8:
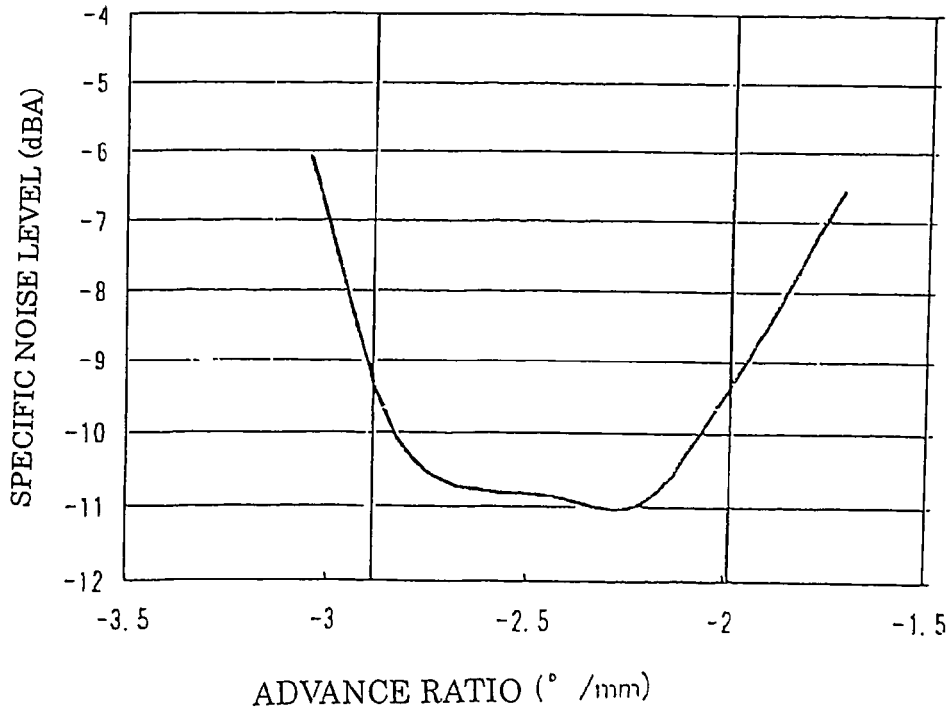
FIG. 8 is a diagram showing the relationship between the advance ratio of the sweepback wing portion of a blade and specific noise level in the blower of Embodiment 1.

FIG. 8 is a diagram showing the performance of the above-described blower as obtained by experiment by the inventor of this invention; the abscissa indicates the advance ratio of the sweepback wing portion 3, and the ordinate indicates the value of the specific noise level (dBA), which is lower when the bell mouth 8 is mounted to the case 19 under a condition of a substantially maximum efficiency point as compared to the case when no bell mouth 8 is mounted.

It can be seen from this diagram that a remarkable effect of achieving a reduction in the noise of the blower can be obtained in the advance ratio ranging from −2.0 (°/mm) to −2.9 (°/mm) and that the specific noise level is reduced by approximately 11 [dBA] at maximum at an advance ratio of −2.2.

Further, as shown in FIG. 4, a portion 4A of the blade portion situated on the outer peripheral side of the inner diameter of the bell mouth 8, that is, in this embodiment, a portion of the sweepback wing portion 3, protrudes from the reduction diameter side end portion 8B toward the expansion diameter side end portion 8C of the bell mouth 8 in the direction along the rotation center axis (rotation axis) 30 of the impeller. In the case in which a portion 4A of the blade portion situated on the outer peripheral side of the inner diameter of the bell mouth 8 does not thus protrude from the reduction diameter side end portion 8B toward the expansion diameter side end portion 8C of the bell mouth 8 in the direction along the rotation center axis (rotation axis) 30 of the impeller, there are generated, between the reduction diameter side end portion 8B and the expansion diameter side end portion 8C of the bell mouth 8, a circular vortex due to the rotation of the impeller and a leakage flow leaking from between the impeller and the reduction diameter side end portion 8B, resulting in an increase in noise and an increase in input.

Further, when, instead of causing a portion 4A of the blade portion to protrude, the space into which the portion 4A of the blade portion is to protrude is filled by, for example, increasing the thickness of the bell mouth, the reduction diameter side end portion and the circular vortex move toward the suction side, and the effective blade area decreases, resulting in an increase in noise and an increase in input.

In view of this, when, as shown in FIG. 4, the portion 4A of the blade portion situated on the outer peripheral side of the inner diameter of the bell mouth 8 is caused to protrude from the reduction diameter side end portion 8B toward the expansion diameter side end portion 8C of the bell mouth 8, the leakage flow generated from between the impeller and the reduction diameter side end portion 8B decreases, so that it is possible to reduce the static pressure increase loss and the air capacity loss due to the leakage flow. Further, since the disturbance generated through leakage decreases, it is possible to achieve a reduction in noise.

Thus, it is possible to control both the circular vortex generated between the reduction diameter side end portion 8B and the expansion diameter side end portion 8C of the bell mouth 8 through rotation of the impeller, and the leakage flow from between the reduction diameter side end portion 8B of the bell mouth 8 and the impeller, so that it is possible to achieve high static pressure and large air capacity, thereby making it possible to achieve an enhancement in efficiency and a reduction in noise.

It is to be noted that this invention is not restricted to the use of an impeller having a composite blade as described above; it is also possible, as in the case of the above composite blade, to achieve an improvement in ventilation efficiency and a reduction in noise in a blower equipped with an ordinary axial blade or a centrifugal blade, a case surrounding the impeller, and a bell mouth cylindrically constricted so as to guide gas into the case, which is constructed such that the inner diameter of the bell mouth is smaller than the outer diameter of the impeller, due to the fact that a portion of the blade portion situated on the outer peripheral side of the inner diameter of the bell mouth protrudes from the reduction diameter side end portion toward the expansion diameter side end portion in the direction along the rotation center axis of the impeller.

Embodiment 2

FIG. 9 is a diagram for illustrating the construction of a blower according to Embodiment 2 of this invention; it is a sectional view taken along the rotation axis (rotation center axis) 30 when the blades 4 are rotating.

In the above-described Embodiment 1, a case was shown in which the boundary portion 5 constituting the boundary between the sweepforward wing portion 2 and the sweepback wing portion 3 substantially coincides with the inner diameter of the bell mouth 8.

In contrast, in this embodiment, as shown in FIG. 9, the boundary portion 5 constituting the boundary between the sweepforward wing portion 2 and the sweepback wing portion 3 is situated on the outer peripheral side of the inner diameter of the bell mouth 8. That is, D1'<D3.

The blade profile of the blade 4 (impeller) on the inner peripheral side of the boundary portion 5 between the sweepforward wing portion 2 and the sweepback wing portion 3 is that of the sweepforward wing portion 2, and, in the region on the inner peripheral side of the inner diameter D1' of the bell mouth 8, the blower operates as an axial blower, so that it provides a large air capacity characteristic. Further, the blade profile of the blade 4 (impeller) on the inner peripheral side of the boundary portion 5 is that of the sweepforward wing portion 2, and, in the region on the outer peripheral side of the inner diameter D1' of the bell mouth 8, constriction is effected by the bell mouth 8, so that a flow expands radially outwards, making it possible to achieve an increase in static pressure due to centrifugal force.

In contrast, the blade profile of the blade 4 (impeller) on the outer peripheral side of the boundary portion 5 between the sweepforward wing portion 2 and the sweepback wing portion 3 is that of the sweepback wing portion 3, so that the blower operates as a centrifugal blower. Thus, substantial coincidence with the meridional flow expanding in the centrifugal direction is effected, so that the load thereon decreases, and the ventilation efficiency is enhanced. Thus, it is desirable for the boundary portion 5 of the blade 4 (impeller) between the sweepforward wing portion 2 and the sweepback wing portion 3 to be on the outer peripheral side of the inner diameter D1' of the bell mouth 8. In view of this, it is desirable for the inner diameter D1' of the bell mouth 8 to be on the boss 1 side with respect to the radial position of the boundary portion 5 of the blade 4 (impeller) between the sweepforward wing portion 2 and the sweepback wing portion 3.

The minimum noise point of an axial blower is on the open side, and the minimum noise point of a centrifugal blower is on the high static pressure side. Thus, by varying the proportion of the sweepforward wing portion 2 and the sweepback wing portion 3, and the inner diameter dimension of the bell mouth 8 according to the requisite operating point, the three-dimensional flow field generated in the impeller (blade 4) is varied, and it is possible to control the flow difference due to the operating point through the inner diameter D1' of the bell mouth 8. For example, when the inner diameter D1' of the bell mouth 8 is reduced, the region where the flow expands radially outwards is enlarged, resulting in a flow state simulating the flow on the high static pressure side of the impeller. In contrast, when the inner diameter D1' of the bell mouth 8 is increased, the region where the flow expands radially outwards is diminished, and the blade region which is on the boss 1 side of the inner diameter D1' of the bell mouth 8 and which operates as an axial blower is enlarged, resulting in a flow state simulating the flow on the low static pressure side.

As described above, in this embodiment, the boundary portion 5 constituting the boundary between the sweepforward wing portion 2 and the sweepback wing portion 3 is situated on the outer peripheral side of the inner diameter of the bell mouth 8, so that, by varying the inner diameter D1' of the bell mouth 8, the three-dimensional flow field generated in the impeller (blades 4) is varied, making it possible to control the flow difference due to the operating point through the inner diameter D1' of the bell mouth 8.

It is to be noted that, as described with reference to Embodiments 1 and 2, this invention is not restricted to the case in which the relationship between the diameter D3 of the boundary portion 5 which constitutes the boundary between the sweepforward wing portion 2 and the sweepback wing portion 3, and the inner diameter D1' of the bell mouth 8 is as follows: D1'<D3; as long as the inner diameter D1' of the bell mouth is smaller than the outer diameter D4 of the blade, it is possible to realize a radial outward flow, making it possible to achieve an increase in static pressure through the flow expanding in the radial direction.

Embodiment 3

Figure 10:
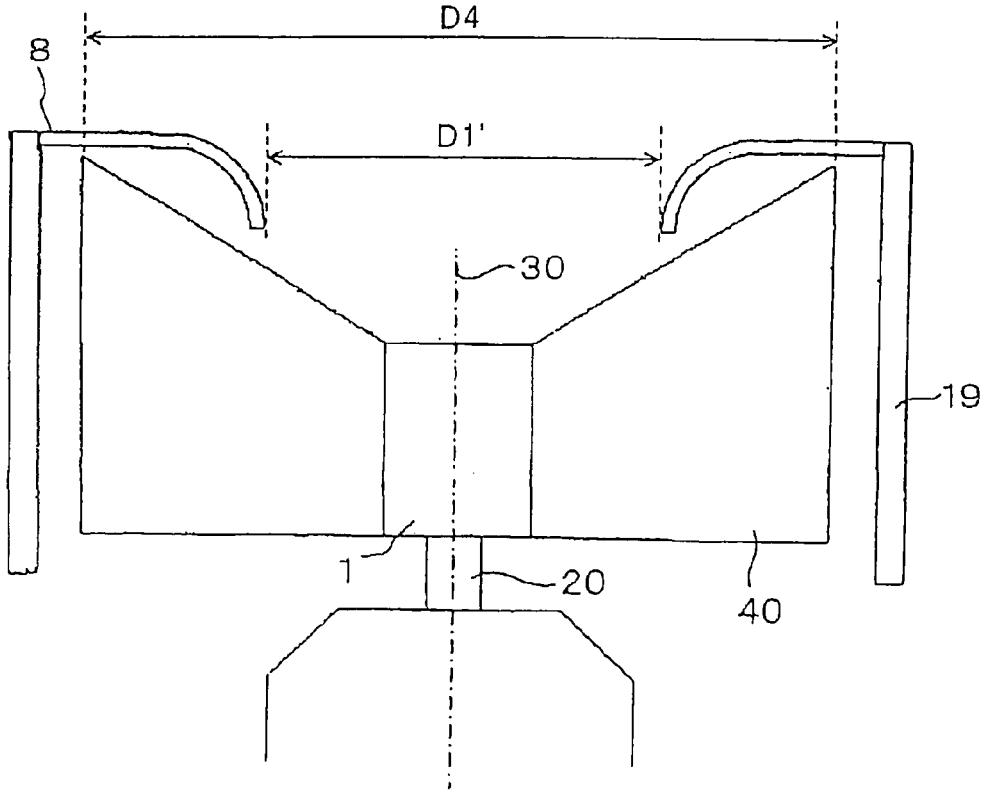
FIG. 10 is a sectional view, taken along the rotation center axis, of a blower according to Embodiment 3 of this invention when the blades thereof are rotating.

FIG. 10 is a diagram for illustrating the construction of a blower according to Embodiment 3 of this invention; it is a sectional view taken along the rotation axis 30 when the blades 4 are rotating.

As shown, for example, in FIGS. 2 and 3, in the above-described Embodiments 1 and 2, a composite blade is employed in which each blade 4 is equipped with the sweepforward wing portion 2 which is on the boss 1 side and which has a positive advance ratio value in the radial direction and the sweepback wing portion 3 which is on the outer peripheral side and which has a negative advance ratio value, with the arc length of each blade 4 gradually increasing from the boss 1 side toward the outer peripheral side. However, this invention is not restricted to the use of an impeller with such a composite blade; also in a blower equipped with an impeller (axial flow impeller) with an ordinary axial flow blade 40, a case 19 surrounding the impeller, and a bell mouth 8 cylindrically constricted so as to guide gas into the case 19, with the inner diameter D1' of the bell mouth 8 being smaller than the outer diameter D4 of the impeller, it is possible, as in the above-described embodiments, to achieve an improvement in ventilation efficiency through an increase in static pressure and to achieve a reduction in noise.

That is, the gas flow when the inner diameter D1' of the bell mouth 8 is smaller than the outer diameter D4 of the axial flow impeller is throttled by the bell mouth when it flows into the impeller on the suction side of the impeller, and gradually expands radially outwards from the bell mouth toward the discharge side.

In the axial flow impeller (axial flow blade 40), in the region on the inner peripheral side of the inner diameter D1' of the bell mouth 8, the blower operates as an axial blower, so that it provides a large air capacity characteristic. In contrast, in the axial flow impeller (axial flow blade 40), in the region on the outer peripheral side of the inner diameter D1' of the bell mouth 8, constriction is effected by the bell mouth, so that the flow expands radially outwards, making it possible to achieve an increase in static pressure by centrifugal force.

Thus, when the inner diameter D1' of the bell mouth 8 is diminished, the region where the flow expands radially outwards is enlarged, resulting in a flow state simulating the flow on the high static pressure side of the axial flow impeller. In contrast, when the inner diameter D1' of the bell mouth 8 is increased, the region where the flow expands radially outwards is diminished, and the blade region which is on the boss 1 side of the inner diameter D1' of the bell mouth 8 and which operates as an axial blower is enlarged, resulting in a flow state simulating the flow on the low static pressure side.

Thus, by varying the inner diameter D1' of the bell mouth 8 within the range of the outer diameter of the axial flow impeller, the three-dimensional flow field generated in the axial flow impeller is varied, making it possible to control the flow field through the magnitude of the inner diameter D1' of the bell mouth 8 as a flow difference due to the operating point.

For example, in the case of use at an operating point on the low static pressure side, the inner diameter D1' of the bell mouth 8 is enlarged, and in the case of use on the high static pressure side, the inner diameter D1' of the bell mouth 8 is diminished.

In this way, by controlling the magnitude of the inner diameter D1' of the bell mouth 8, it is possible to control the operating point, and it is possible to use the impeller at the target operating point, so that it is possible to achieve a reduction in noise and an improvement in efficiency.

As described above, by making the inner diameter of the bell mouth smaller than the outer diameter of the axial flow impeller, it is possible to realize a radial outward flow, making it possible to achieve an increase in static pressure by the flow expanding in the radial direction.

Further, since the bell mouth guiding air flow is arranged on the suction side of the axial blower (axial flow impeller), there is the effect of making the distribution of the suction flow irrespective of the mounting condition of the axial flow impeller, so that it is possible to reduce the disturbance flowing into the axial flow impeller and to achieve a reduction in noise.

Figure 11:
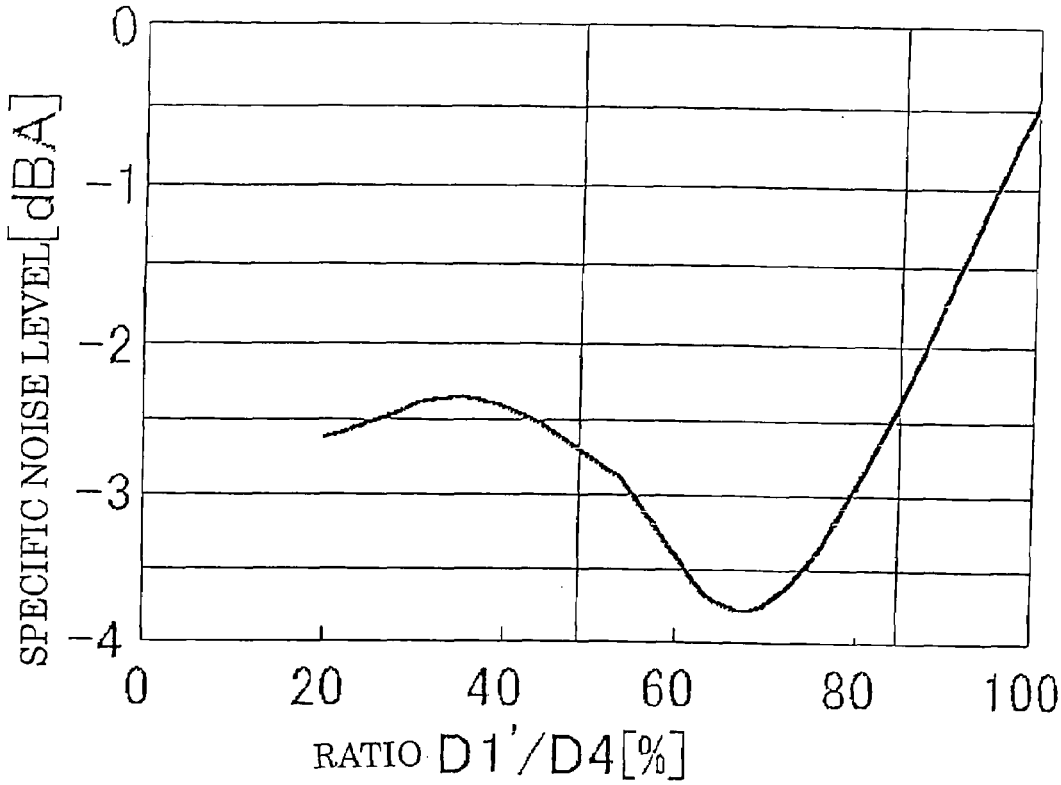
FIG. 11 is a diagram showing the relationship between ratio (%) and the relative value of specific noise level in the blower of Embodiment 3.

FIG. 11 is a diagram showing the performance of the above-described blower as obtained by experiment by the present inventor; the abscissa indicates a ratio D1'/D4 (%) when the inner diameter (given as D1' in FIG. 10) of the bell mouth 8 is varied, with the outer diameter (given as D4 in FIG. 10) of the axial flow impeller formed by the boss 1 and four axial flow blades 40 being fixed; and the abscissa indicates the value of a specific noise level Ks (dBA), which is reduced when the bell mouth 8 is mounted to the case 19 than when no bell mouth 8 is mounted.

As can be seen from FIG. 11, in the range of the ratio from approximately 50% to 85%, the specific noise level is reduced, thus providing a marked noise reducing effect.

Figure 12:
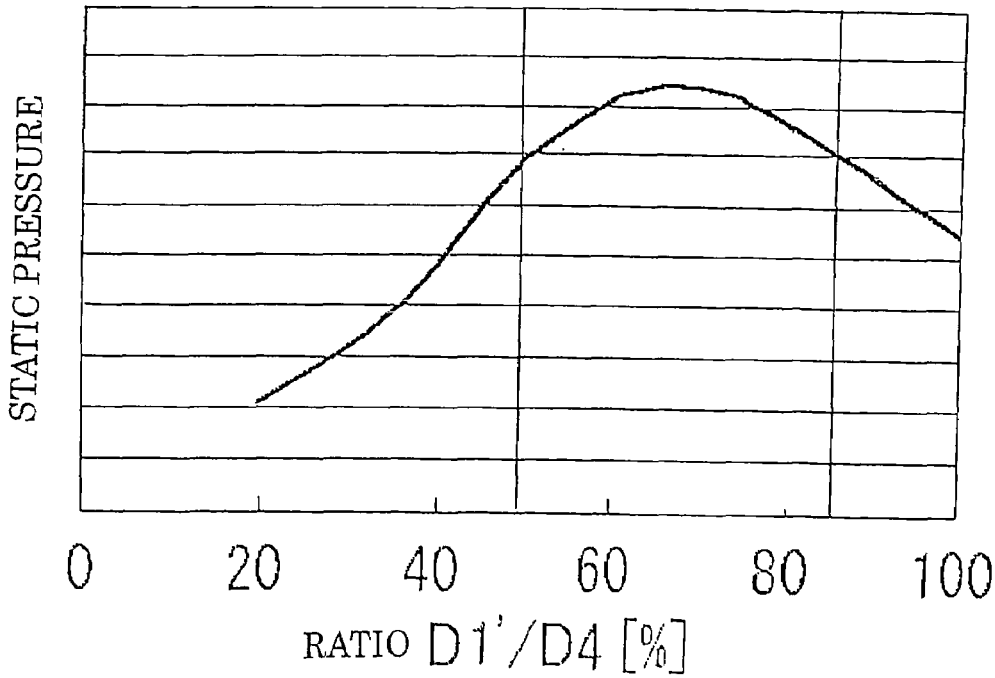
FIG. 12 is a diagram showing the relationship between ratio (%) and the relative value of static pressure difference in the blower of Embodiment 3.

FIG. 12 is a diagram showing the performance of the above-described blower as obtained by experiment by the present inventor; the abscissa indicates the ratio D1'/D4 (%) when the inner diameter (given as D1' in FIG. 10) of the bell mouth 8 is varied, with the outer diameter (given as D4 in FIG. 10) of the axial flow impeller formed by the boss 1 and four axial flow blades 40 being fixed; and the ordinate indicates a relative value of a static pressure difference between the upstream and downstream sides of the blower.

As can be seen from FIG. 12, in the range of the ratio from approximately 50% to 85%, the specific noise level is reduced, thus providing a marked noise reducing effect.

From the results of FIGS. 11 and 12, when the inner diameter dimension D1 of the bell mouth 8 is not less than 50%, more preferably not less than 85%, of the outer diameter dimension D4 of the axial flow impeller, it is possible to achieve an increase in static pressure and a reduction in noise in the axial flow blower, with the large air capacity characteristic of the axial flow impeller being impaired only to a relatively small degree.

Embodiment 4

Figure 13:
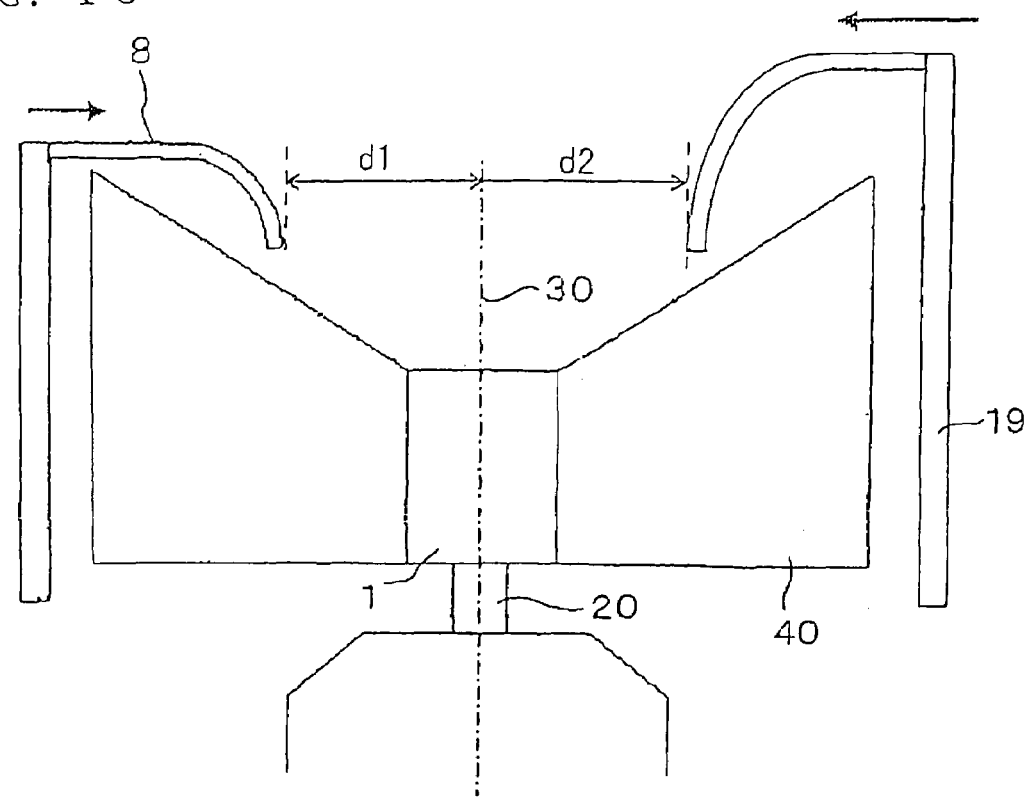
FIG. 13 is a sectional view, taken along the rotation center axis, of a blower according to Embodiment 4 of this invention when the blades thereof are rotating.
Figure 14:
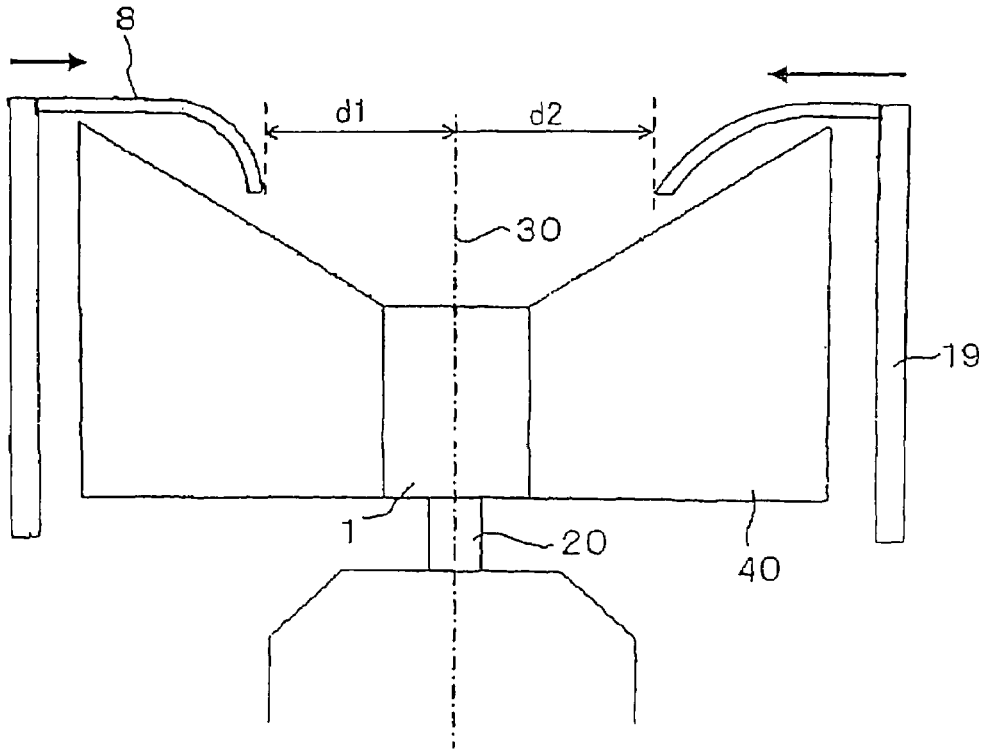
FIG. 14 is a sectional view, taken along the rotation center axis, of a blower according to Embodiment 4 of this invention when the blades thereof are rotating.

FIG. 13 is a diagram for illustrating the construction of a blower according to Embodiment 4 of this invention; it is a sectional view taken along the rotation axis 30 when the blades 4 are rotating; and FIG. 14 is a diagram for illustrating another construction of the blower of Embodiment 4 of this invention; it is a sectional view taken along the rotation axis 30 when the blades 4 are rotating. In the drawings, the thick arrows indicate the gas inflow direction; the longer the arrows, the higher the flow velocity.

The air course in which the impeller is arranged differs depending on the mounting condition; in some cases, there arises a difference in suction flow velocity in the circumferential direction of the rotation center axis 30 of the impeller on the impeller suction side. In such cases, the inner face of the constricting portion from the expansion diameter side end portion to the reduction diameter side end portion of the bell mouth 8 is formed as a curved surface spaced apart from the rotation center axis 30 of the impeller by an uneven distance, and, in the portion where the flow velocity is high, the curvature of the inner face of the constricting portion of the bell mouth is made larger than in the other portions, whereby the disturbance generated by separation on the bell mouth is reduced, making it possible to prevent an increase in noise. Further, the uneven distribution of the flow velocity on the suction side generated by the circumferentially uneven construction of the air course is smoothened, making it possible to reduce the rotation noise due the unevenness in the flow velocity on the suction side.

As shown in FIG. 13, in this embodiment, the distance from the rotation center axis 30 of the impeller at the reduction diameter side end portion of the bell mouth 8 is the same on the right and left sides as seen in the plane of FIG. 13; that is, a left distance d1 and a right distance d2 are equal to each other. Further, by making the length (height) between the expansion diameter side end portion and the reduction diameter side end portion as measured in the direction of the rotation center axis 30 longer on the right-hand side, the inner face of the constricting portion is formed such that it is spaced apart from the rotation center axis 30 of the impeller by different distances on the right-hand and left-hand sides of FIG. 13. That is, the curvature of the right-hand side portion of the inner face of the constricting portion, which constitutes the high-velocity inflow side, is larger than that on the left-hand side.

As shown in FIG. 14, it is also possible to adopt a construction in which the distance between the expansion diameter side end portion and the reduction diameter side end portion as measured in the direction of the rotation center axis 30 is the same on the left-hand side and the right-hand side and in which only the curvature is varied, making the curvature of the inner face of the constricting portion on the right-hand side, which constitutes the high-velocity inflow side, larger than on the left-hand side.

While the construction shown in FIGS. 13 and 14 are applied to a blower having the axial flow blade 40, the same effect can be obtained through the same construction if applied to a blower having the composite blade 4.

While in the above-described embodiments four blades are mounted to the boss, the number of blades is of course not restricted thereto; this invention is applicable to a case where a plurality of blades are mounted.

Further, this blower is not restricted to a blower for ventilation; it is naturally also applicable to a blower for cooling the heat exchanger, for example, of an automobile, a refrigerator, or an air conditioner.

Further, what is blown is not restricted to air; any gas will serve the purpose.

As described above, in the blower of the present invention, the inner diameter of the bell mouth is smaller than the outer diameter of the axial flow impeller, so that the flow is turned into a mixed flow and an increase in static pressure is achieved due to centrifugal force; thus, it is possible to achieve an improvement in ventilation efficiency and to generate a flow field where the flow in the vicinity of the blade surface is matched with the blade, thereby making it possible to achieve a reduction in noise.

Further, the inner diameter of the bell mouth is smaller than the outer diameter of the impeller, and a portion of the blade portion situated on the outer peripheral side of the inner diameter of the bell mouth protrudes from the reduction diameter side end portion toward the expansion diameter side end portion of the bell mouth in the direction along the rotation center axis of the impeller, so that it is possible to control both the circular vortex, which is generated between the reduction diameter side end portion and the expansion diameter side end portion of the bell mouth through the rotation of the impeller, and the leakage flow from between the reduction diameter side end portion of the bell mouth and the impeller, whereby it is possible to achieve an increase in static pressure and an increase in air capacity, thereby making it possible to achieve an improvement in ventilation efficiency and a reduction in noise.

Further, the blade is equipped with the sweepforward wing portion which is on the boss side and which exhibits a positive advance ratio value in the radial direction and the sweepback wing portion which is on the outer peripheral side and which exhibits a negative advance ratio value, with the arc length of the blade increasing from the boss side toward the outer peripheral side, so that it is possible to achieve an improvement in ventilation efficiency through an increase in static pressure and to achieve a reduction in noise.

The invention claimed is:

1. A blower comprising:

an impeller having an outer diameter and a plurality of axial flow blades, the axial flow blades being mounted at circumferential intervals on an outer peripheral surface of a boss; and a bell mouth having an opening with an inner diameter, the bell mouth being generally coaxial with the impeller and cylindrically constricted to guide gas to the impeller, wherein the inner diameter of the bell mouth is in a range from 50% to 85% of the outer diameter of the impeller, and an inner face of a constricting portion of the bell mouth, extending from a wider, expansion diameter side of the bell mouth to a narrower, reduction diameter side of the bell mouth, has a curved surface spaced apart from a rotational axis of the impeller by a distance that is circumferentially uneven.

2. A blower comprising:

an impeller having an outer diameter, rotating about a rotational axis, and including a plurality of blades, the blades being mounted at circumferential intervals to an outer peripheral surface of a boss of the impeller; and a bell mouth having an opening with an inner diameter, the bell mouth being generally coaxial with the impeller and cylindrically constricted to guide gas to the impeller, wherein a peripheral portion of each blade has a tip, and part of each tip is disposed directly opposite the bell mouth and extends beyond the opening of the bell mouth along a direction parallel to the rotational axis of the impeller, toward the bell mouth, and the inner diameter of the opening of the bell mouth is smaller than the outer diameter of the impeller at the part of each tip which is disposed directly opposite the bell mouth and extends beyond the opening of the bell mouth along a direction parallel to the rotational axis of the impeller, toward the bell mouth.

3. The blower according to claim 2, wherein, when the blades of the impeller are projected onto a plane perpendicular to the rotational axis of the impeller, then each of curves formed by connecting center points of arc lengths of circumferentially extending arcs, formed though overlapping of concentric circles, which radially extend around an intersection point of the plane and the rotational axis, and the projected blades, is defined as a circumferential center curve, an angle made between a straight line connecting the intersection point and a boss-side end point of the circumferential center curve and a straight line connecting the intersection point and an arbitrary point in the circumferential center curve is defined as a forward angle $\theta$, with a rotating direction of the blades taken as positive, a change ratio per unit radial length of the forward angle $\theta$ is defined as an advance ratio, and each blade has, in a radial direction, a sweepforward wing portion which is on a boss side and which exhibits a positive value of the advance ratio, and a sweepback wing portion which is on an outer peripheral side of the blade and which exhibits a negative value of the advance ratio, with the arc length of each blade increasing from the boss side toward the outer peripheral side.

4. The blower according to claim 3, wherein a portion of the sweepback wing portion protrudes from a reduction diameter side of the bell mouth toward an expansion diameter side of the bell mouth in a direction along the rotational axis of the impeller.

5. A blower comprising:

an impeller having an outer diameter and a plurality of axial flow blades, the axial flow blades being mounted at circumferential intervals on an outer peripheral surface of a boss; and a bell mouth having an opening with an inner diameter, the bell mouth being generally coaxial with the impeller and cylindrically constricted to guide gas to the impeller, wherein the inner diameter of the bell mouth is in a range from 50% to 85% of the outer diameter of the impeller, wherein, when the blades of the impeller are projected onto a plane perpendicular to the rotational axis of the impeller, then each of curves formed by connecting center points of arc lengths of circumferentially extending arcs, formed through overlapping of concentric circles, which radially extend around an intersection point of the plane and the rotational axis, and the projected blades, is defined as a circumferential center curve, an angle made between a straight line connecting the intersection point and a boss-side end point of the circumferential center curve and a straight line connecting the intersection point and an arbitrary point in the circumferential center curve is defined as a forward angle $\theta$, with a rotating direction of the blades taken as positive, a change ratio per unit radial length of the forward angle θ is defined as an advance ratio, and each blade has, in a radial direction, a sweepforward wing portion which is on a boss side and which exhibits a positive value of the advance ratio, and a sweepback wing portion which is on an outer peripheral side of the blade and which exhibits a negative value of the advance ratio, with the arc length of each blade increasing from the boss side toward the outer peripheral side.

6. The blower according to claim 5, wherein a boundary between the sweepforward wing portion and the sweepback wing portion substantially coincides with the inner diameter of the bell mouth.

7. The blower according to claim 5, wherein a boundary between the sweepforward wing portion and the sweepback wing portion is situated outside of the inner diameter of the bell mouth.

8. The blower according to claim 5, wherein diameter of the boundary has a ratio to the inner diameter of the bell mouth ranging from 80% to 130%.

9. The blower according to claim 8, wherein the ratio ranges from 100% to 110%.

10. The blower according to claim 5, wherein an inner face of a constricting portion of the bell mouth, extending from a wider expansion diameter side of the bell mouth to a narrower, reduction diameter side of the bell mouth, has a curved surface spaced apart from the rotational axis of the impeller by a distance that is circumferentially uneven.

11. A blower comprising a boss and a plurality of blades mounted at circumferential intervals to an outer peripheral surface of the boss, wherein, when the blades of the impeller are projected onto a plane perpendicular to the rotational axis of the impeller, then each of curves formed by connecting center points of arc lengths of circumferentially extending arcs, formed through overlapping of concentric circles, which radially extend round an intersection point of the plane and the rotational axis, and the projected blades, is defined as a circumferential center curve, an angle made between a straight line connecting the intersection point and a boss-side end point of the circumferential center curve and a straight line connecting the intersection point and an arbitrary point in the circumferential center curve is defined as a forward angle θ, with a rotating direction of the blades taken as positive, a change ratio per unit radial length of the forward angle θ is defined as an advance ratio, each blade has, in a radial direction, a sweepforward wing portion which is on a boss side and which exhibits a positive value of the advance ratio, and a sweepback wing portion which is on an outer peripheral side of the blade and which exhibits a negative value of the advance ratio, with the arc length of each blade increasing from the boss side toward the outer peripheral side, a straight line extended from a center point of a height taken along a direction of the rotational axis, at a portion of each blade in contact with the boss, to an outer peripheral portion of the blade, perpendicular to the rotational axis, is defined as a straight line V, a line obtained by connecting center points of the height in the direction of the rotational axis, at each radial of the blade is defined as a radial direction center line Z, a line connecting the center of the height of each blade at the boss and an arbitrary point in the radial direction center line Z is defined as a straight line Y, and the straight line Y is inclined toward a gas suction side with respect to the straight line V.

12. The blower according to claim 11, wherein, in the circumferential center curve of the sweepforward wing portion, an angle of inclination of a tangent to the circumferential center curve increases gradually and toward a gas discharge side as the circumferential center curve extends from the boss side toward a boundary portion side, and the angle of inclination of the tangent to the circumferential center curve increases gradually and toward a gas suction side as the circumferential center curve extends from the boundary portion side toward the outer peripheral side.

13. The blower according to claim 11, wherein the sweepback wing portion of each of the blades has an advance ratio ranging from −2.0°/mm to −2.9°/mm.

* * * * *